US011183800B2

(12) United States Patent
Mattei et al.

(10) Patent No.: US 11,183,800 B2
(45) Date of Patent: Nov. 23, 2021

(54) PIN AND SLEEVE DEVICE WITH INDICATION

(71) Applicant: LEVITON MANUFACTURING CO., INC., Melville, NY (US)

(72) Inventors: Michael Mattei, St. James, NY (US); Amit Pai, Farmingville, NY (US); Robert Cannetti, Lindenhurst, NY (US); Gaurav Surana, Farmingdale, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 16/481,845

(22) PCT Filed: Jul. 22, 2019

(86) PCT No.: PCT/US2019/042745
§ 371 (c)(1),
(2) Date: Jul. 30, 2019

(87) PCT Pub. No.: WO2020/046493
PCT Pub. Date: Mar. 5, 2020

(65) Prior Publication Data

US 2021/0167559 A1 Jun. 3, 2021

Related U.S. Application Data

(60) Provisional application No. 62/724,255, filed on Aug. 29, 2018.

(51) Int. Cl.
*H01R 13/717* (2006.01)
*H01R 4/48* (2006.01)
(Continued)

(52) U.S. Cl.
CPC ..... *H01R 13/7175* (2013.01); *H01R 4/48* (2013.01); *H01R 12/7005* (2013.01); *H01R 13/41* (2013.01); *H01R 13/6683* (2013.01)

(58) Field of Classification Search
CPC ..... H01R 13/6658; H01R 13/641; H01R 13/6541; H01R 13/6683; H01R 13/7175;
(Continued)

(56) References Cited

U.S. PATENT DOCUMENTS 2,428,563 A 10/1947 Fountain
2,660,717 A 11/1953 Hood
(Continued)

FOREIGN PATENT DOCUMENTS

GB 2552202 A 1/2018
WO 1990007787 A1 7/1990
(Continued)

OTHER PUBLICATIONS

Author unknown, "60 & 63A 2W/3P, 3W/4P & 4W/5P pin & sleeve switched connectors" Hubbell Wiring Device—Kellems—Hubbell Incorporated—Sep. 23, 2015.
(Continued)

*Primary Examiner* — Gary F Paumen
(74) *Attorney, Agent, or Firm* — Kacvinsky Daisak Bluni PLLC

(57) ABSTRACT

An electrical pin and sleeve device is disclosed. The pin and sleeve device incorporating one or more features to facilitate easier assembly and use. For example, the pin and sleeve device may include one or more indicators (e.g., LEDs) mounted on a printed circuit board (PCB) for providing power supply indication, and/or status or fault notification. Additionally, and/or alternatively, the PCB may be adapted and configured to be inserted into one or more slots formed in the contact carrier and/or the body member of the device.
(Continued)

Additionally, and/or alternatively, the PCB may receive electrical power via clips coupled to electrical wires or leads, the clips electrically contacting the pins and/or sleeves of the device.

17 Claims, 7 Drawing Sheets

(51) Int. Cl.
*H01R 12/70* (2011.01)
*H01R 13/41* (2006.01)
*H01R 13/66* (2006.01)

(58) Field of Classification Search
CPC ..... H01R 13/41; H01R 23/025; H01R 4/48; H01R 12/7005
USPC ..... 439/76.1, 490
See application file for complete search history.

(56) References Cited

U.S. PATENT DOCUMENTS

| | | | | |
|---|---|---|---|---|
| 2,698,879 | A | 1/1955 | Shepherd | |
| 3,007,105 | A | 10/1961 | Klokow | |
| 3,778,801 | A | 12/1973 | Nudelmont | |
| 3,848,160 | A | 11/1974 | Boothman et al. | |
| 4,111,516 | A | 9/1978 | Wireman | |
| 4,298,864 | A | 11/1981 | Mahnke et al. | |
| 4,318,578 | A | 3/1982 | Ericson et al. | |
| 4,345,477 | A | 8/1982 | Johnson | |
| 4,500,160 | A | 2/1985 | Bertsch | |
| 4,606,597 | A | 8/1986 | Bielefeld | |
| 4,671,597 | A | 6/1987 | Grill | |
| 5,244,409 | A | 9/1993 | Guss, III et al. | |
| 5,297,015 | A | 3/1994 | Miyazaki et al. | |
| 5,409,398 | A | 4/1995 | Chadbourne et al. | |
| 5,544,089 | A | 8/1996 | Hemminger et al. | |
| 5,555,508 | A | 9/1996 | Munday et al. | |
| 5,567,175 | A | 10/1996 | Warden et al. | |
| 5,652,420 | A | 7/1997 | Innes et al. | |
| 5,699,051 | A | 12/1997 | Billig et al. | |
| 5,971,597 | A | 10/1999 | Baldwin et al. | |
| 5,973,594 | A | 10/1999 | Baldwin et al. | |
| 6,285,912 | B1 | 9/2001 | Ellison et al. | |
| 6,362,445 | B1 | 3/2002 | Marchand et al. | |
| 6,380,911 | B1 | 4/2002 | Eaton | |
| 6,746,250 | B2 | 6/2004 | Blutbacher | |
| 6,802,741 | B1 | 10/2004 | Shatkin | |
| 6,827,602 | B2 | 12/2004 | Greene et al. | |
| 6,867,364 | B2 | 3/2005 | Hafskjold et al. | |
| 6,991,495 | B1 * | 1/2006 | Aromin | H01H 83/14 361/42 |
| 7,086,892 | B2 | 8/2006 | Tanacan et al. | |
| 7,168,974 | B2 | 1/2007 | Feldman et al. | |
| 7,758,373 | B2 * | 7/2010 | Zhou | H01R 13/6658 439/490 |
| 7,911,338 | B2 | 3/2011 | Naeve et al. | |
| 8,443,355 | B2 | 5/2013 | Wiese et al. | |
| 8,662,905 | B2 * | 3/2014 | Chang | H01R 13/44 439/142 |
| 8,935,435 | B2 | 1/2015 | Reidt | |
| 9,118,122 | B2 * | 8/2015 | Liu | H01R 11/22 |
| 9,673,614 | B2 | 6/2017 | Westerlund | |
| 9,792,805 | B2 | 10/2017 | Itzler et al. | |
| 9,819,226 | B2 | 11/2017 | Yang et al. | |
| 9,858,796 | B2 | 1/2018 | Ricciuti | |
| 9,887,489 | B1 * | 2/2018 | Dietz | H01R 13/6275 |
| 2006/0040546 | A1 | 2/2006 | Werthman et al. | |
| 2009/0233487 | A1 | 9/2009 | Zhou et al. | |
| 2011/0119507 | A1 | 5/2011 | Reidt | |
| 2012/0275084 | A1 | 11/2012 | Familiant et al. | |
| 2015/0118918 | A1 * | 4/2015 | Liu | H01R 4/18 439/877 |
| 2015/0192619 | A1 | 7/2015 | Javora et al. | |
| 2016/0156225 | A1 | 6/2016 | Yang et al. | |
| 2016/0261106 | A1 | 9/2016 | Westerlund | |
| 2016/0343232 | A1 | 11/2016 | Itzler et al. | |
| 2017/0068267 | A1 | 3/2017 | El-Gayyer | |
| 2017/0184674 | A1 | 6/2017 | Okerman | |
| 2017/0193793 | A1 | 7/2017 | Ricciuti | |
| 2017/0270769 | A1 | 9/2017 | Itzler et al. | |
| 2018/0123287 | A1 * | 5/2018 | Dietz | H01R 13/6271 |

FOREIGN PATENT DOCUMENTS

| | | | |
|---|---|---|---|
| WO | 1993017390 | A1 | 9/1993 |
| WO | 1995029526 | A1 | 11/1995 |
| WO | 2001050561 | A1 | 7/2001 |
| WO | 2002035494 | A1 | 5/2002 |
| WO | 2002035495 | A1 | 5/2002 |
| WO | 2002041336 | A1 | 5/2002 |
| WO | 2005039111 | A1 | 4/2005 |
| WO | 2008007160 | A2 | 1/2008 |
| WO | 2009016472 | A2 | 2/2009 |
| WO | 2011018106 | A1 | 2/2011 |
| WO | 2012148897 | A1 | 11/2012 |
| WO | 2014044408 | A1 | 3/2014 |
| WO | 2015055233 | A1 | 4/2015 |
| WO | 2016149369 | A1 | 9/2016 |
| WO | 2018075231 | A1 | 4/2018 |

OTHER PUBLICATIONS

Author unknown, "Switched Pin & Sleeve Connectors—Installation Instructions" Hubbell Wiring Device—Kellems—Hubbell Incorporated—Jan. 2018.

Author unknown, "Advantage™ Series Switch-Rated IEC Pin and Sleeve" Hubbell Wiring Device—Kellems—Hubbell Incorporated—May 2016.

Author unknown, "Pin & Sleeve" 2016 Leviton Manufacturing Co., Inc.

International Search Report and Written Opinion, Application No. PCT/US2019/042745, dated Dec. 9, 2019, 18 pages.

* cited by examiner

PIN AND SLEEVE DEVICE WITH INDICATION

CROSS-REFERENCE TO RELATED APPLICATIONS

This application is a United States National Phase filing of International Application No. PCT/US19/42745, filed Jul. 22, 2019, which claims priority to, and the benefit of the filing date of, U.S. Provisional Patent Application Ser. No. 62/724,255, filed Aug. 29, 2018, entitled "Pin and Sleeve Device with Indication," the entire contents of each application is hereby incorporated in its entirety.

FIELD OF THE DISCLOSURE

The present disclosure relates generally to electrical devices such as pin devices and corresponding sleeve devices, and more particularly to pin devices and sleeve devices incorporating one or more features to facilitate easier assembly and use.

BACKGROUND OF THE DISCLOSURE

Pin and sleeve devices including plugs, connectors, receptacles, inlets, mechanical interlocks, etc. are well known in the art. As used herein, pin devices and sleeve devices will be collectively referred to as pin and sleeve devices. Herein, a single device having either pins (e.g. a plug), sleeves (e.g. a connector), or both pins and sleeves will be referred to as a pin and sleeve device. However, reference to a pin and sleeve device is not intended to mean that any such device has to include both pins and sleeves. Such a device can include one or more pins, one or more sleeves, or both pins and sleeves.

Generally speaking, pin and sleeve devices are often used to supply electrical power in harsh or high abuse environments such as, for example, wet or corrosive environments. Pin and sleeve devices are well-suited to supply electrical power to heavy equipment such as, for example, welders, motors, compressors, conveyors, portable tools, portable lighting, etc. In use, pin and sleeve devices may provide electrical connections safe from dust and water. As such, pin and sleeve devices are designed to provide power connections that are safe and secure from the environment (e.g., moisture, dirt, grime, chemicals, etc.), prevent accidental disconnect under load, and ensure high strength durability. Pin and sleeve devices provide standardized connectors (e.g., devices are interconnectable across manufacturers) and may be rated at any suitable current and voltage levels. For example, pin and sleeve devices may be rated at current levels of 16A, 20A, 30A, 32A, 60A, 100A, 150A, 200A, 400A, or the like. In addition, pin and sleeve devices may be rated at voltage levels of 125V, 240V, 250V, 480V, 600V, 100/130V, 125/250V, 102/208V, 200/250V, 208/250V, 277/480V, 346-415V, 347/600V, 380/415V, 440-460V, and others. Moreover, pin and sleeve devices may be rated for any suitable electrical phase configuration such as single-phase, three-phase delta, and three-phase wye.

It would be desirable to provide pin and sleeve devices with one or more features to facilitate easier assembly and use.

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is an electrical pin and sleeve device including an outer housing, a contact carrier, a body member, a plurality of electrical contacts, a printed circuit board (PCB) electrically coupled to the electrical contacts, an indicator arranged and configured on the PCB to provide power supply indication, the indicator being electrically connected to the plurality of electrical contacts, and a lens disposed within the outer housing, the lens being arranged and configured to be optically aligned with the indicator.

In another embodiment, an electrical pin and sleeve device may include an outer housing, a contact carrier, a body member, a plurality of electrical contacts, and a printed circuit board (PCB) including a tab on an end thereof, wherein the contact carrier or the body member includes one or more slots formed therein, the one or more slots being sized and configured to receive the tab formed on the PCB for mounting the PCB to the contact carrier or body member.

In another embodiment, an electrical pin and sleeve device may include an outer housing, a contact carrier, a body member, a plurality of electrical contacts, a printed circuit board (PCB), an indicator arranged and configured on the PCB to provide power supply indication, and a lens disposed within the outer housing, the lens being arranged and configured to be optically aligned with the indicator, wherein the PCB is electrically coupled to the plurality of electrical contacts via a plurality of leads, the plurality of leads each having a first end electrically coupled to the PCB and a second end electrically coupled to a clip, the clip arranged and configured to be in electrical contact with the electrical contacts of the device.

BRIEF DESCRIPTION OF THE DRAWINGS

By way of example, a specific embodiment of the disclosed device will now be described, with reference to the accompanying drawings, in which.

Figure 1:
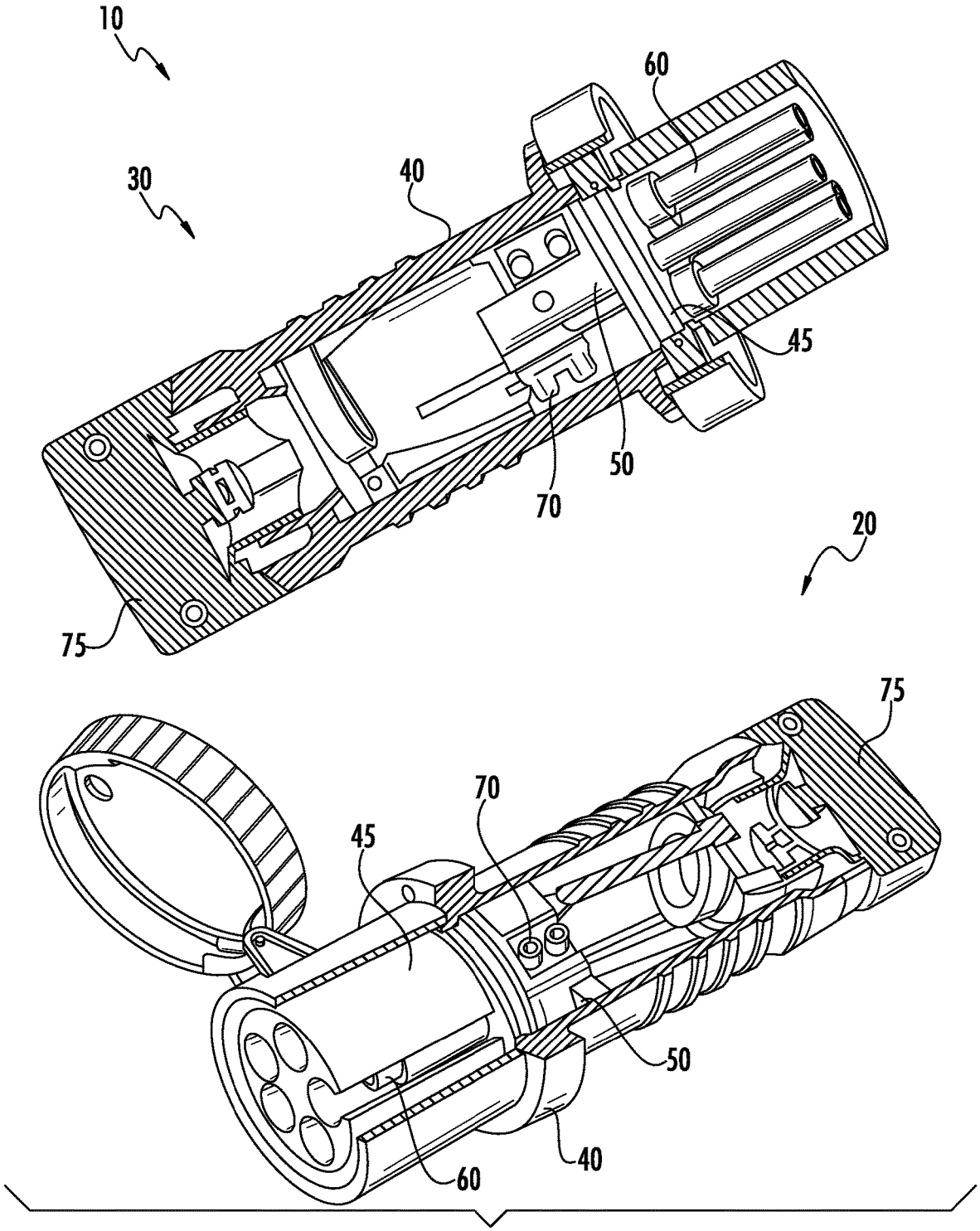
FIG. 1 (PRIOR ART)
FIG. 1 shows cut-away views of known pin and sleeve devices (e.g., a plug and a connector, respectively)

The drawings are not necessarily to scale. The drawings are merely representations, not intended to portray specific parameters of the disclosure. The drawings are intended to depict example embodiments of the disclosure, and therefore are not be considered as limiting in scope. In the drawings, like numbering represents like elements.

DETAILED DESCRIPTION

Numerous embodiments of improved pin and sleeve devices in accordance with the present disclosure will now be described more fully hereinafter with reference to the accompanying drawings, in which preferred embodiments of the present disclosure are presented. As will be described and illustrated, in some embodiments, the electrical pin and sleeve device incorporates one or more features to facilitate easier assembly and use. The pin and sleeve device of the present disclosure may, however, be embodied in many different forms and should not be construed as being limited to the embodiments set forth herein. Rather, these embodiments are provided so that this disclosure will convey certain example aspects of the pin and sleeve device to those skilled in the art. In the drawings, like numbers refer to like elements throughout unless otherwise noted.

As will be described in greater detail below, in various embodiments, a pin and sleeve device according to the present disclosure may include one or more features to facilitate easier assembly and use. That is, for example, according to the present disclosure, an electrical pin and sleeve device may include one or more indicators for providing power supply indication, status, and/or fault indications. The indicators (e.g., LEDs) may be mounted directly to a printed circuit board (PCB). In use, the PCB may be coupled to the pin and sleeve device by inserting a portion of the PCB into a slot formed in the contact carrier of the pin and sleeve device. Additionally, power may be provided to the PCB by electrical wires or leads (used interchangeably herein) coupled to clips adapted and configured to contact the electrical contacts (e.g., pins and sleeves) of the pin and sleeve device.

As will be described herein, the features according to the present disclosure may be used with any suitable electrical pin and sleeve device now known or hereafter developed. As such, details regarding construction and operation of the electrical pin and sleeve devices are omitted for sake of brevity of the present disclosure. In this regard, the present disclosure should not be limited to the details of the electrical pin and sleeve device disclosed and illustrated herein unless specifically claimed and that any suitable electrical pin and sleeve device can be used in connection with the principles of the present disclosure.

Generally speaking, as will be appreciated by one of ordinary skill in the art, pin and sleeve devices are used to supply power to connected devices. As will be appreciated by one of ordinary skill in the art, pin and sleeve devices may encompass plugs, connectors, receptacles, inlets, mechanical interlocks, etc. These devices will be collectively referred to herein as a pin and sleeve device without the intent to limit.

Referring to FIG. 1, in one embodiment, a connector 20 may be connected to power and a plug 30 may be connected to a downstream electrical device, or vice-versa (e.g., reverse-service). In use, the plug 30 may be connected to the connector 20 to supply power to the downstream electrical device. As will be readily appreciated by one of ordinary skill in the art, each of the pin and sleeve devices 10 may include an outer housing 40, a contact carrier 45, a body member 50, and electrical contacts 60. The electrical contacts 60 in the connector 20 may generally be in the form of sleeves while the electrical contacts 60 in the plug 30 may generally be in the form of pins for contacting the sleeves in the connector 20. Sleeves and pins are arranged and configured to electrically contact and mechanically engage with each other. Optionally, each of the pin and sleeve devices 10 may also include one or more terminal screws 70 for securing electrical conductors of an electrical cable 15 (FIG. 2) to the contacts, a cord clamp 75 for securing the electrical cable 15 to the pin and sleeve device 10, one or more grommets or seals, a cap, etc. Additionally, as will be appreciated by one of ordinary skill in the art, an inlet (not shown) may be used in place of a plug for coupling to a connector, and/or a receptacle may be used in place of a connector for coupling to a plug in a panel or box mount.

Figure 2:
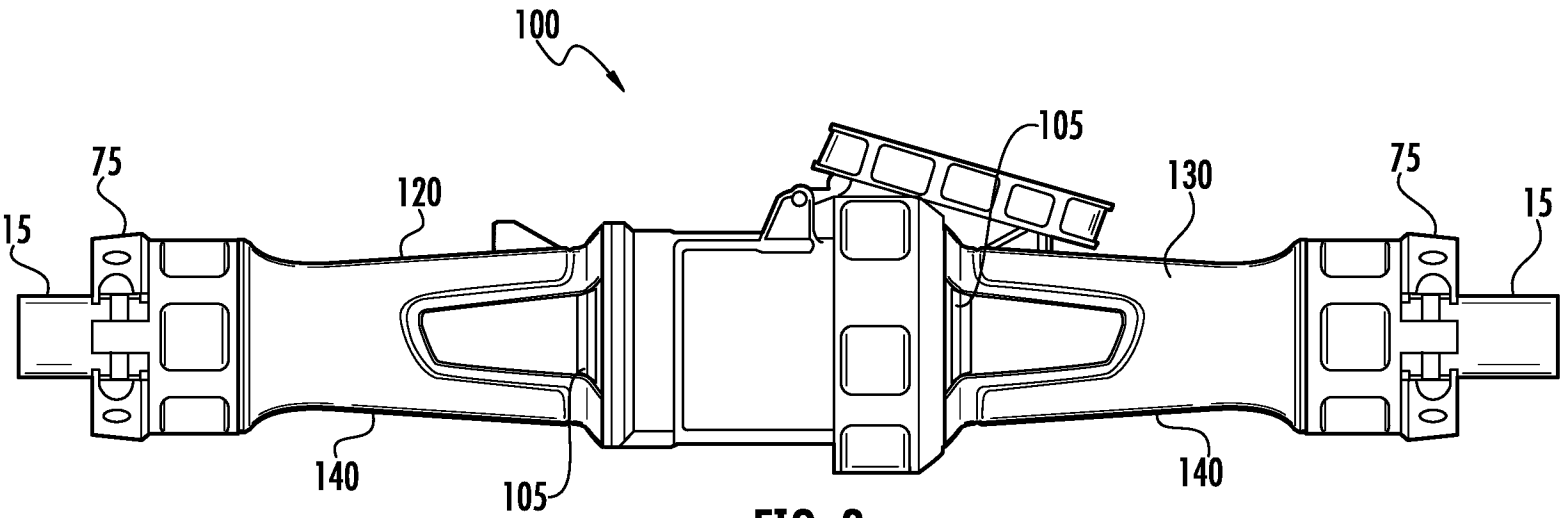
FIG. 2 is a side view of example embodiments of pin and sleeve devices in accordance with one aspect of the present disclosure, the pin device shown coupled to the sleeve device.

In accordance with one or more various aspects of the present disclosure, referring to FIG. 2, as will be appreciated by one of ordinary skill in the art, a plug 130 may be coupled to a connector 120. As previously mentioned, the connector 120 may be connected to power via electrical conductors of a first electrical cable 15 and the plug 130 may be connected to a downstream electrical device via electrical conductors of a second electrical cable 15. In this manner, power may be supplied to the downstream electrical device.

Figure 3A:
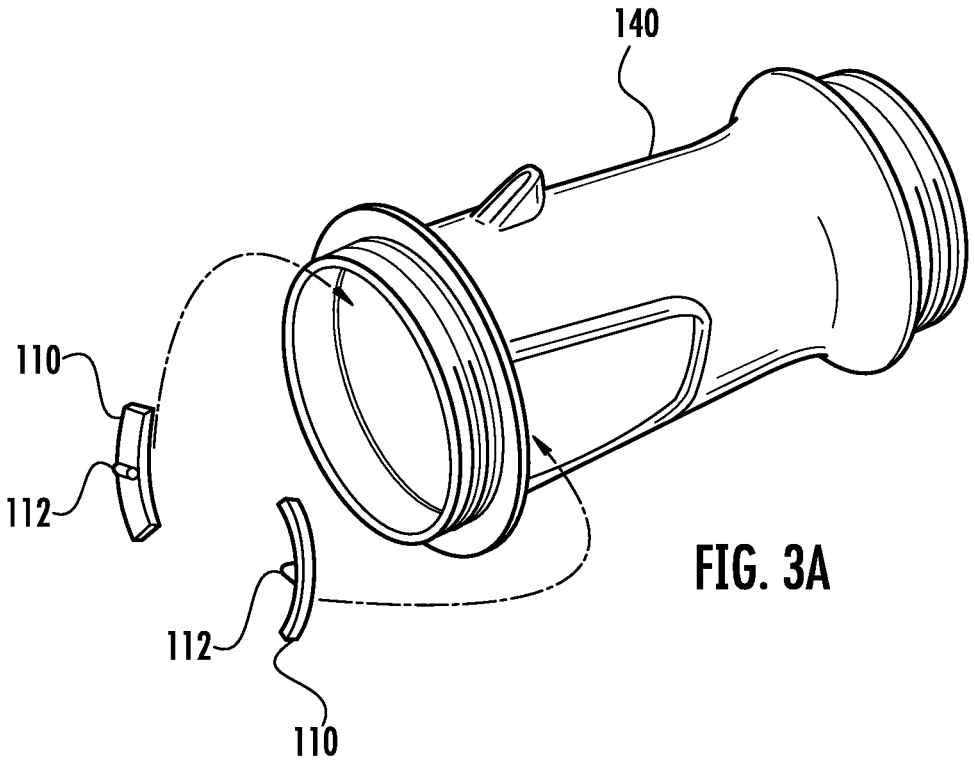
FIG. 3A is an exploded, perspective view of an example embodiment of a pin and sleeve device in accordance with one aspect of the present disclosure.
Figure 3B:
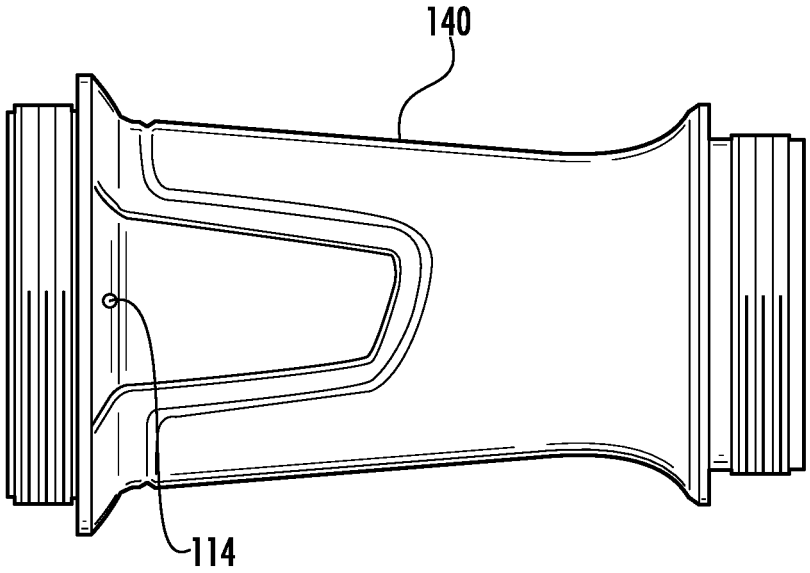
FIG. 3B is a side view of an example embodiment of an outer housing for use with the pin and sleeve device shown in FIG. 3A.

Referring to FIGS. 2-3B, in one example embodiment according to the present disclosure, one or more of the pin and sleeve devices 100 (e.g., connector 120 or plug 130) may include an indicator 105 (e.g. an LED) (FIGS. 4, 5B and 5C) integrated into the pin and sleeve device 100 to indicate, for example, when power is being supplied to the pin and sleeve device 100. That is, as will be described in greater detail below, the pin and sleeve device 100 may include a light such as, for example, a light emitting diode (LED) or the like, to indicate, for example, when power is supplied to the pin and sleeve device 100.

The outer housing 140 of the pin and sleeve device 100 may include one or more transparent or translucent lens 110 (FIGS. 2 and 3A). The lens 110 may be coupled to the outer housing 140 by any suitable mechanism now known or hereafter developed. For example, as illustrated in FIG. 3A, the lens 110 may include a projection 112 adapted and configured for receipt within a corresponding recess 114 (FIG. 3B) formed in the outer housing 140. In use, as will be described in greater detail below, when assembled the one or more lenses 110 are aligned with one or more indicators (e.g., LEDs) 105 (FIGS. 4, 5B and 5C) positioned within the outer housing 140 of the pin and sleeve device 100. In this manner, when power is supplied to the pin and sleeve device 100, the indicator (e.g., LED) 105 will turn ON, shining light through the lens 110 and thereby providing indication to the user that the pin and sleeve device 100 is receiving electrical power. As will be appreciated by one of ordinary skill in the art, the connector 120 may indicate power via the indicator (e.g., LED) 105 and lens 110 immediately upon connection to a branch circuit while the plug 130 will indicate power via its indicator (e.g., LED) 105 and lens 110 once the plug 130 has been coupled to the connector 120.

In this manner, in use, the indicator (e.g., LED) 105 provides indication of power. In addition, the indicator 105 may also be used to indicate, for example, one or more statuses or faults. For example, as will be described in greater detail, each pin and sleeve device 100 may include an indicator 105 that is associated with or positioned on a printed circuit board (PCB). The PCB may be adapted and configured to flash the indicator 105 in one or more sequences based on a particular fault or status code for the respective device. That is, in some embodiments, multiple indicators 105, colored indicators 105, and/or flashing sequences can be implemented to indicate status, fault or other notifications. For example, if a loss of ground is detected, the indicator 105 may flash twice within five seconds; if a loss of neutral is detected, the indicator 105 may flash three times in five seconds; and if a loss of phase is detected, the indicator 105 may flash four times in five seconds. Alternatively, it is envisioned that multiple different colors of indicators 105 may be incorporated. For example, if a loss of ground is detected, a green indicator 105 may turn ON; if a loss of neutral is detected, a red indicator 105 may turn ON; and if a loss of phase is detected, a yellow indicator 105 may turn ON. In addition, the pin and sleeve device 100 may incorporate one or more sensors such as, for example, a humidity sensor, a temperature sense, or the like. If an operating characteristic of a respective sensor is outside of a preferred operating range, a fault signal may be generated. It should be understood that the described examples of indicating faults are exemplary and numerous different sequences, colors, or the like may be utilized.

Figure 4:
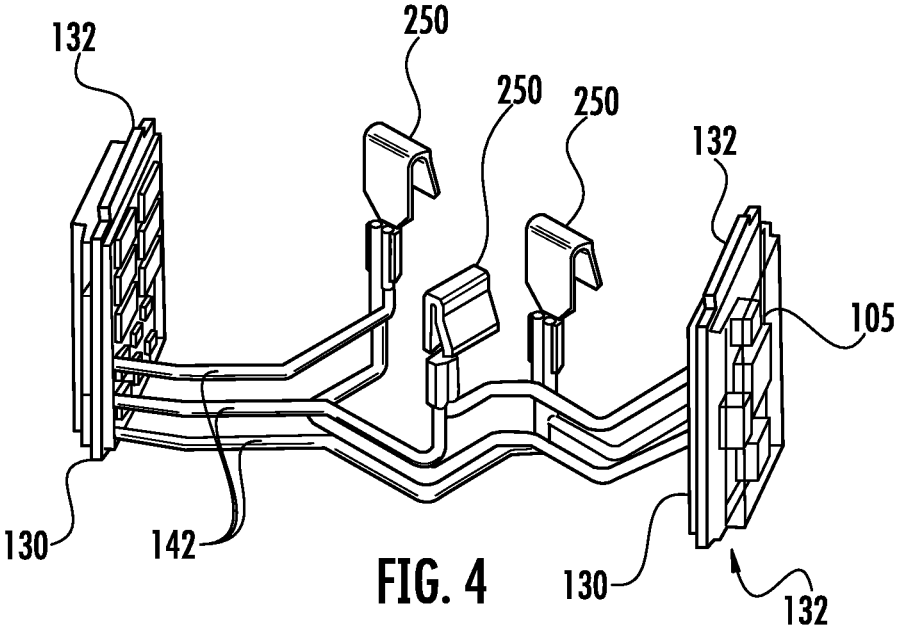
FIG. 4 is a perspective view of an example embodiment of a printed circuit board (PCB) arrangement for use with a pin and sleeve device in accordance with one aspect of the present disclosure.
Figure 5A:
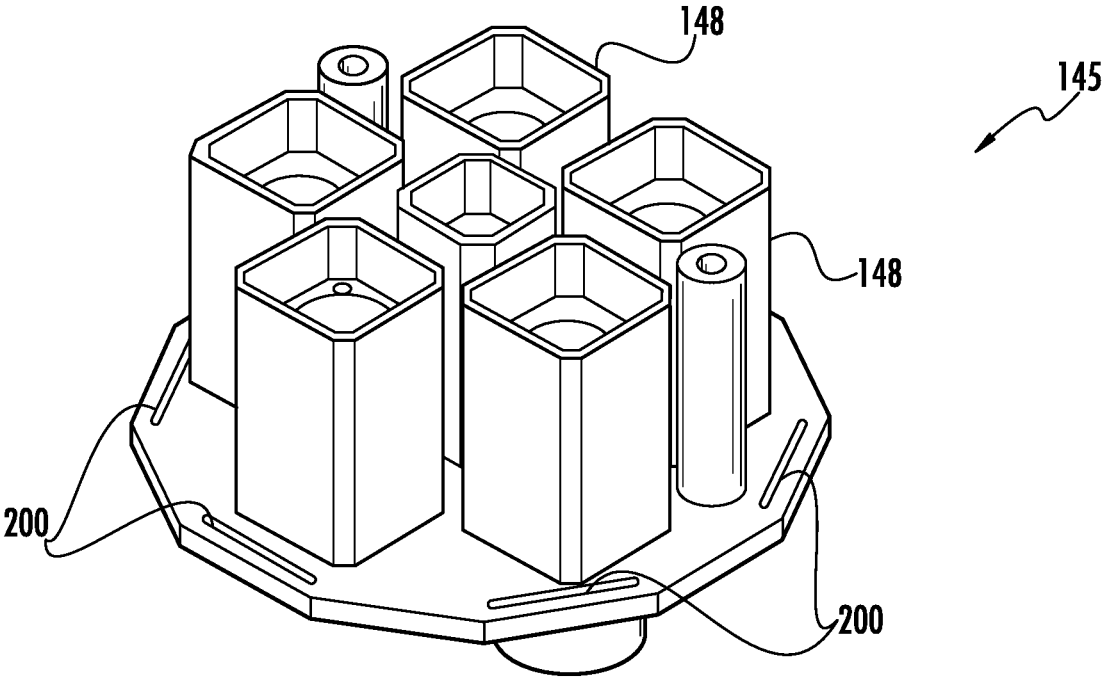
FIG. 5A is a perspective view of an example embodiment of a contact carrier for use in a pin and sleeve device in accordance with one aspect of the present disclosure.
Figure 5B:
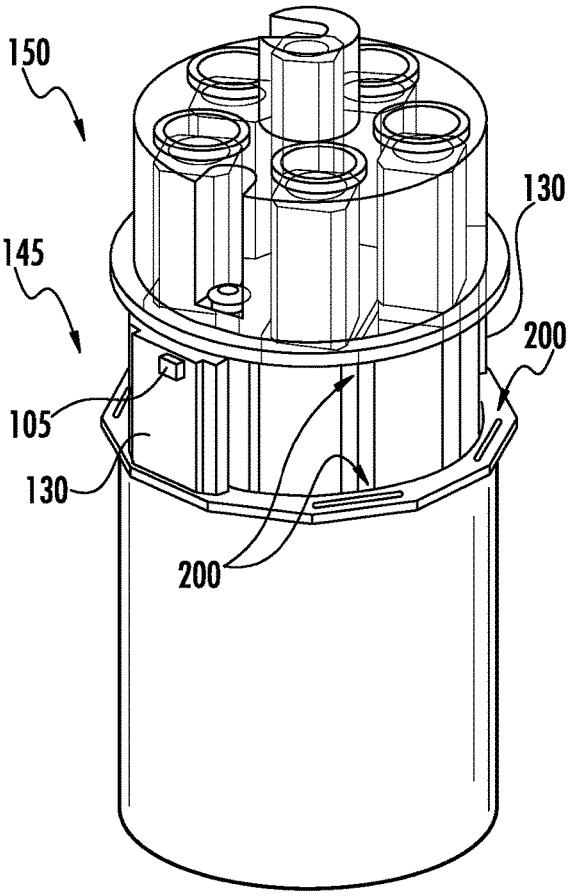
FIG. 5B is a perspective view of an example embodiment of a pin and sleeve device in accordance with one aspect of the present disclosure.
Figure 5C:
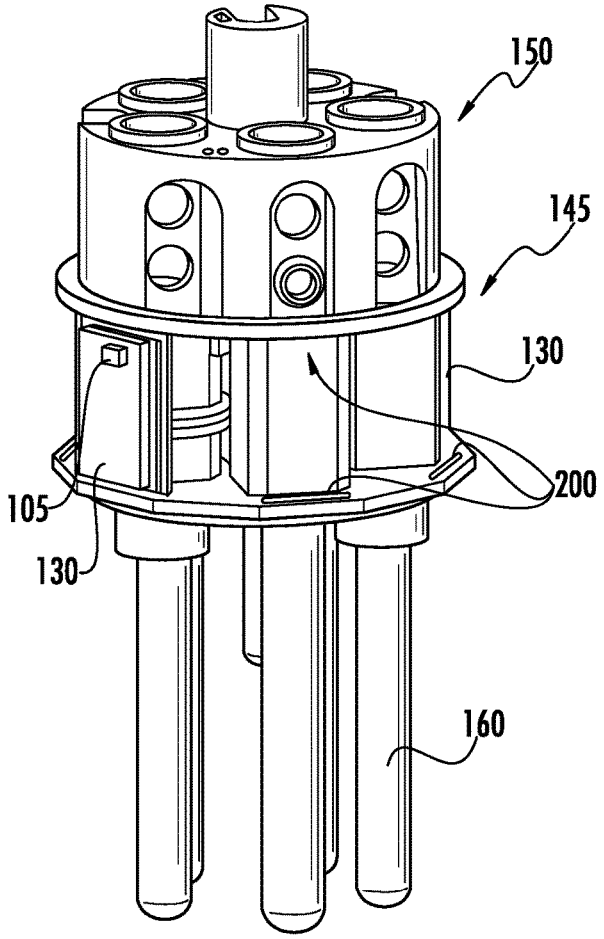
FIG. 5C is a perspective view of an alternate example embodiment of a pin and sleeve device in accordance with one aspect of the present disclosure.

Referring to FIG. 4, and as previously mentioned, in one example embodiment, the indicators (e.g., LEDs) 105 may be mounted directly onto one or more PCBs 130. In use, PCBs 130 may be incorporated to provide any needed functionality such as, for example, RFID, Bluetooth or other wireless communication, sensors, etc. In one embodiment, as illustrated, the PCB 130 may include an indicator 105. In use, the PCBs 130 may be mounted and powered within the pin and sleeve device 100 by any suitable mechanisms now known or hereafter developed. Referring to FIGS. 5A-5C, in one example embodiment, the one or more PCBs 130 may be mounted to a contact carrier 145 and/or a body member 150 of the pin and sleeve device 100. That is, as illustrated, the contact carriers 145 may include one or more slots 200 for receiving a portion of the associated PCB 130. Additionally, and/or alternatively, the body member 150 may include one or more slots 200 for receiving a portion of the associated PCB 130. In one embodiment, the PCBs 130 may be formed with tabs 132 (FIG. 4) on either end thereof, the slots 200 formed in the contact carrier 145 and/or the body member 150 being sized and configured to receive the tabs 132 formed on/extending from the PCBs 130. The tabs 132 may be, for example, press-fitted, snap-fitted, or the like into the slots 200, or any other mechanism now known or hereafter developed.

Utilization of slots 200 for receiving and retaining the PCBs 130 provides numerous advantages over current techniques. For example, utilization of slots 200 enables the PCBs 130 to be inserted into the slots 200 formed in the contact carrier 145 and/or body member 150 and held in position without any additional fasteners. This is useful when retaining the PCBs 130 in tight confines. Moreover, formation of multiple slots 200 around the circumference (e.g. clock positions) of the contact carrier 145 and/or body member 150 enables variable placement of the PCBs 130 enabling multiple different installations within the same pin and sleeve device 100. That is, utilization of slots 200 enables insertion of additional PCBs 130 as required, in different circumferential positions as needed. Additionally, formation of multiple slots 200 provides space for insertion of additional and/or multiple PCBs, indicators, and sensors. For example, as mentioned herein, formation of multiple slots 200 may enable incorporation of multiple PCBs for providing indication, wireless communication, monitoring of operation characteristics (e.g., sensors), etc.

Additionally, utilization of slots 200 in the contact carrier 145 and/or body member 150 for receiving and retaining portions of the PCBs 130 allows for easier assembly and movement or repositioning of the PCBs 130 as required for each individual pin and sleeve device 100 while ensuring that the PCBs are securely engaged. Also ensures proper indication (e.g., LED) 105 placement (e.g., ensures that that the indicator (e.g., LED) 105 is properly aligned with the lens 110 and/or light pipe). Additionally, utilization of slots 200 also allows for thermal expansion of components while mitigating undesirable stresses within the pin and sleeve device 100.

In addition, as previously mentioned, the pin and sleeve device 100 may also incorporate one or more sensors such as, for example, humidity sensors and temperature sensors. Incorporation of slots 200 in the contact carrier 145 and/or body member 150 may also be used to conveniently mount one or more of the various sensors, or to mount one or more registration members to ensure proper alignment of the various components.

As will be appreciated by one of ordinary skill in the art, while slots 200 have been illustrated as having a generally rectangular shape, other shapes are envisioned. For example, in some embodiments, the plurality of slots 200 may have different configurations for receiving different components. That is, for example, one or more rectangular slots may be used for mating with a PCB while one or more square or trapezoidal slots may be used for mating with a sensor.

Moreover, PCBs 130 may include one or more mating features to prevent incorrect insertion of PCBs (e.g., prevent backwards placement of PCBs, upside down placement of PCBs, incorrect or wrong PCB from being installed, or the like). In this manner, the possibility for incorrect placement of components or the installation of an incorrect component is thereby eliminated, or at least minimized. For example, in one embodiment, a PCB may include a certain size, shape, or incorporate a projection or the like for ensuring that the PCB is only capable of being inserted into a specific contact carrier.

While mounting and fastening of the PCBs 130 has been illustrated and described via slots 200 formed in the contact carrier 145 and/or body member 150, it should be understood that other fastening mechanisms are envisioned including, for example, fasteners, adhesive, welding, interference fit, snap-fit, or the like.

Figure 6:
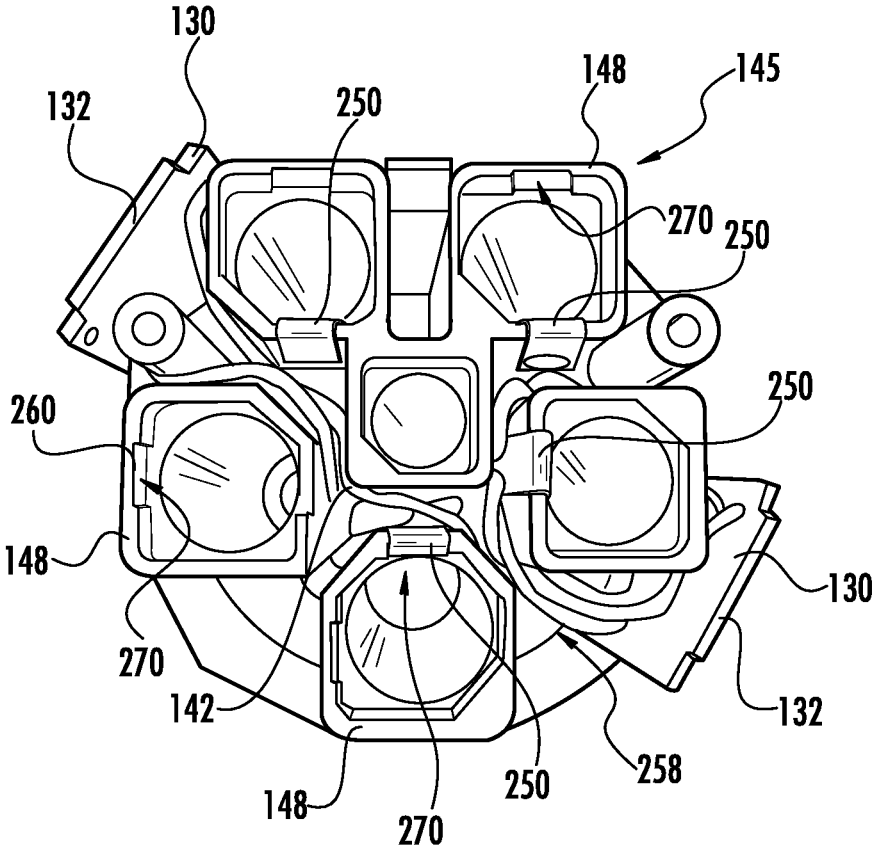
FIG. 6 is a top, perspective view of a PCB arrangement coupled to a contact carrier in accordance with one aspect of the present disclosure.

Referring to FIGS. 4 and 6, in one example embodiment, power to the PCBs 130 (and, in turn, for example, the indicator (e.g., LED) 105) may be supplied via one or more electrical wires or leads 142 (wires or leads used interchangeable herein without the intent to limit), which, in use, are in electrical contact with the contacts 160 (e.g. pins and sleeves) of the various pin and sleeve device 100. As will be appreciated by one of ordinary skill in the art, the PCBs 130 may include or be coupled to a drive circuit for reducing the voltage to a level appropriate for the PCBs and LEDs.

Referring to FIGS. 4 and 6-7B, to ensure proper contact between the electrical wires 142 and the contacts 160 (e.g., pins and sleeves) of the pin and sleeve device 100, the electrical wires 142 may be connected to a clip 250. In this manner, by utilizing a clip 250 to connect the electrical wires 142 to the electrical contacts 160 of the pin and sleeve device 100, an improved reliable connection may be achieved between the small gage wire (e.g., 22 AWG) of the PCBs 130 and the large gauge, high current contacts 160 (e.g., 100A with 2AWG wires).

Figure 7A:
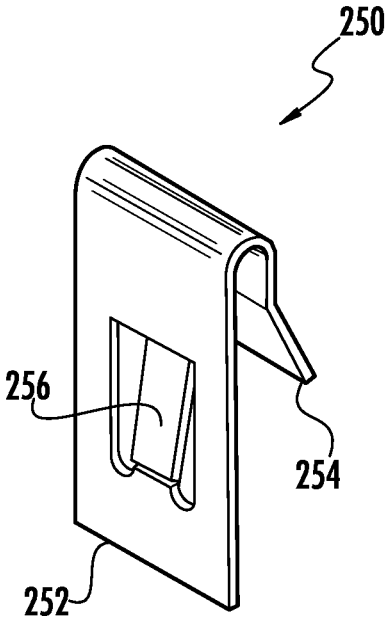
FIG. 7A is a rear, perspective view of an example embodiment of a clip assembly for use in a pin and sleeve device in accordance with one aspect of the present disclosure.
Figure 7B:
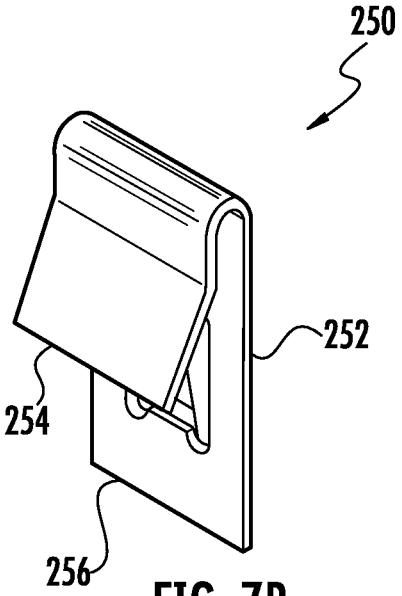
FIG. 7B is a front, perspective view of the clip shown in FIG. 7A.

In use, the clips 250 may be provided in any suitable form for interconnecting the electrical wire 142 and contacts 160. Referring to FIGS. 7A and 7B, in one example embodiment, the clip 250 may include a body portion 252, a spring portion 254 (e.g. flexible or elastic portion) for contacting the electrical contacts 160 of the male pin and female sleeve device 100, and a tab 256 for facilitating connection of the clip 250 to, for example, the contact carrier 145. That is, in use, the contact carrier 145 may include a plurality of sleeves, tubes or the like 148 for receiving the electrical contacts 160 of the pin and sleeve device 100. As used herein, sleeves or tubes are used interchangeably without implying any specific geometry or cross-section. For example, the tubes could have any shape including, for example, circular, rectangular, square, or the like. Additionally, the tubes could be closed or split. In one illustrated embodiment, the clips 250 are adapted and configured to connect to the tubes 148 and for contacting the electrical contacts 160 positioned within the tubes 148. In one embodiment, one or more recesses 260 (e.g. grooves, reliefs, spaces) may be formed in the ends of the tubes 148 for receiving a portion of the clips 250. Utilization of the recess 260 in the ends of the tubes 148 of the contact carriers 145 facilitates easier assembly by providing an indication or predefined location of where the clip 250 should be positioned relative to the tubes 148. In addition, formation of the recesses 260 minimizes the possibility that the clips 250 may become dislodged during use.

In addition, and/or alternatively, the tubes 148 may include one or more pockets, recesses, grooves, or the like 270 on an inner surface of the tubes 148 so that, in use, deformation of the clips 250, as may otherwise occur when mating contacts 160 from mating pin and sleeve devices 100 are connected, is minimized or prevented (e.g., utilization of a pocket 270 on the inner surface of the tubes 148 prevents deformation of the clips 250 when adjacent electrical contacts 160 are mated together).

As previously mentioned, the tab 256 extends from the body portion 252 of the clip 250 to facilitate a secure mating engagement between the clips 250 and the tubes 148 of the contact carrier 145. In the illustrated embodiment of FIGS. 7A and 7B, in use, the tab 256 projects away from the body portion 252 and towards the tube 148 of the contact carrier 145 to act as a retention feature formed in the clip 250 to facilitate maintaining engagement of the clip 250 relative to the tubes 148. Additionally, in use, the clips 250 may be held captive between contact carriers of connected pin and sleeve devices 100.

In addition, in use, the clips 250 may be adapted and configured to wiggle or float relative to the tubes 148 of the contact carrier 145 (i.e., able to move relative to the tubes 148) so that as the electrical contacts 160 (e.g., pins and sleeves) move during use, the clips 250 are better able to adjust/adapt to maintain secure contact. That is, in use, the spring portion 254 is adapted and configured to act as a flexible member, akin to a leaf spring, to ensure electrical contact is maintained with the installed electrical contact 160. Incorporation of the spring portion 254 accommodates movement or float of the electrical contacts (e.g., pin or sleeve) 160 within the contact carrier 145. In addition, the spring portion 2546 accommodates manufacturing tolerances necessary to ensure proper mating with other connecting devices. In this manner, the incorporation of the spring portion 254 of the clips 250 ensure a failsafe electrical contact with the floating contacts 160 (e.g., pins and/or sleeves) of the pin and sleeve device 100 is maintained.

The body portion 252, the spring portion 254, and the tab 256 of the clips 250 may be integrally formed. Alternatively, they may be separately formed and coupled together. In the illustrated example embodiment of FIGS. 7A and 7B, the spring portion 254 may be formed by bending an end portion of the clip 250 thus forming a "U" shaped member with the flatter body portion 252. The U-shaped end portion may have the same or different length relative to the body portion 252. The clip 250 may be manufactured from any suitable material including, for example, a copper alloy for good electrical conductivity and solderability. The clips 250 may also be plated for corrosion protection. In use, the electrical wires 142 may be connected to the clips 250 by any suitable method including, for example, welding, solder, or the like. As illustrated, the electrical wires 142 may be routed through the open spaces 258 residing between adjacent tubes 148.

While the present disclosure refers to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. All rotational references describe relative movement between the various elements. Identification references (e.g., primary, secondary, first, second, third, and fourth) are not intended to connote importance or priority but are used to distinguish one feature from another. The drawings are for purposes of illustration only and the dimensions, positions, order and relative to sizes reflected in the drawings attached hereto may vary.

What is claimed is:

1. An electrical pin and sleeve device comprising:

an outer housing;

a contact carrier including a plurality of tubes having a recess formed in an end thereof;

a body member;

a plurality of electrical contacts at least partially positioned within the plurality of tubes, respectively;

a printed circuit board (PCB);

an indicator arranged and configured on the PCB to provide power supply indication; and a lens disposed within the outer housing, the lens being arranged and configured to be optically aligned with the indicator;

wherein the PCB is electrically coupled to the plurality of electrical contacts via a plurality of leads, the plurality of leads each having a first end electrically coupled to the PCB and a second end electrically coupled to a clip, each clip being at least partially disposed within one of the recesses formed in the end of the plurality of tubes so that the clip is at least partially positioned within one of the plurality of tubes and into contact with the electrical contacts positioned within the tubes of the device.

2. The pin and sleeve device of claim 1, wherein the PCB is electrically coupled to the electrical contacts; and the indicator provides fault notification, the indicator being electrically connected to the plurality of electrical contacts.

3. The pin and sleeve device of claim 2, wherein the fault notification includes one or more of loss of ground, loss of neutral, and loss of phase.

4. The pin and sleeve device of claim 2, wherein the fault notification includes one of a flashing sequence, multicolored indicators, and a plurality of different indicators for each notification.

5. The pin and sleeve device of claim 2, wherein the indicator comprises one or more light emitting diodes (LEDs).

6. The pin and sleeve device of claim 2, further comprising a sensor arranged and configured to sense an operational characteristic within the outer housing, the sensor including one or more of a temperature sensor and a humidity sensor.

7. The pin and sleeve device of claim 2, wherein the contact carrier includes one or more slots formed therein, the one or more slots configured to receive the PCB.

8. The pin and sleeve device of claim 7, wherein the PCB includes a tab on an end thereof, the tab being sized and configured for insertion into one of the slots for mounting the PCB to the contact carrier.

9. The pin and sleeve device of claim 8, wherein the body member includes one or more slots for receiving a portion of the PCB, the PCB including a second tab on a second end thereof, the second tab being sized and configured for insertion into one of the slots formed in the body member for mounting the PCB in-between the contact carrier and the body member.

10. The pin and sleeve device of claim 1, wherein the indicator is further arranged and configured to provide indication of an operational characteristic within the outer housing.

11. The pin and sleeve device of claim 10 further comprising a sensor arranged and configured to sense the operational characteristic, the sensor including one or more of a temperature sensor and a humidity sensor.

12. The pin and sleeve device of claim 1, wherein the clip includes a body portion and a spring portion for contacting the electrical contacts of the pin and sleeve device.

13. The pin and sleeve device of claim 12, wherein the tubes further comprise a pocket formed in an inner surface of the tube for selectively receiving the spring portion of the clip.

14. The pin and sleeve device of claim 1, wherein the indicator is adapted and configured to supply at least one of a status or a fault notification.

15. The pin and sleeve device of claim 1, wherein the contact carrier or the body member includes one or more slots formed therein, the one or more slots configured to receive the PCB.

16. The pin and sleeve device of claim 15, wherein the contact carrier and the body member each include one or more slots for receiving a portion of the PCB.

17. The pin and sleeve device of claim 16, wherein the PCB includes a first tab on a first end thereof and a second tab on a second end thereof, the first tab being sized and configured for insertion into one of the slots formed in the contact carrier, the second tab being sized and configured for insertion into one of the slots formed in the body member for mounting the PCB in-between the contact carrier and the body member.

* * * * *